US007287298B2

(12) United States Patent
Shinler

(10) Patent No.: US 7,287,298 B2
(45) Date of Patent: Oct. 30, 2007

(54) LOW PROFILE SIDE SQUEEGEE ASSEMBLY

(75) Inventor: Kevin Leroy Shinler, North Branch, MN (US)

(73) Assignee: Tennant, Minneapolis, MN (US)

( * ) Notice: Subject to any disclaimer, the term of this patent is extended or adjusted under 35 U.S.C. 154(b) by 0 days.

(21) Appl. No.: 11/073,786

(22) Filed: Mar. 7, 2005

(65) Prior Publication Data

US 2005/0193518 A1 Sep. 8, 2005

Related U.S. Application Data

(60) Provisional application No. 60/550,884, filed on Mar. 5, 2004.

(51) Int. Cl.
*E01H 1/02* (2006.01)

(52) U.S. Cl. ..... 15/320; 15/340.1; 15/401; 15/50.1; 15/78

(58) Field of Classification Search ..... 15/320, 15/340.1, 340.2, 340.3, 340.4, 401
See application file for complete search history.

(56) References Cited

U.S. PATENT DOCUMENTS 3,386,126 A * 6/1968 Hadekel ..... 15/250.47
3,879,793 A * 4/1975 Schlegel ..... 15/250.201
4,037,289 A * 7/1977 Dojan ..... 15/320
4,805,258 A 2/1989 Sitarski et al.
5,212,848 A 5/1993 Geyer
5,454,138 A * 10/1995 Mondigo et al. ..... 15/354
5,455,985 A 10/1995 Hamline et al.
5,623,743 A * 4/1997 Burgoon et al. ..... 15/320
5,943,730 A 8/1999 Boomgaarden
6,088,873 A 7/2000 Pacchini et al.
6,895,633 B2 5/2005 Tucker
2002/0170130 A1 11/2002 Shinler

* cited by examiner

*Primary Examiner*—David Redding
(74) *Attorney, Agent, or Firm*—Altera Law Group, LLC

(57) ABSTRACT

A low-profile side squeegee assembly for surface maintenance vehicles, capable of cleaning under so-called "toe kicks". In contrast with typical suspensions that are mounted directly above the center of the squeegee assembly, and are therefore too tall to fit under toe kicks, a low-profile suspension attaches at the ends of a squeegee assembly, and uses torsion springs to provide a downward force on the squeegee assembly. In order to counteract any potential twisting effects that might result from suspending the squeegee from the ends rather than the center, the squeegee assembly is mounted at an angle.

5 Claims, 6 Drawing Sheets

LOW PROFILE SIDE SQUEEGEE ASSEMBLY

CROSS-REFERENCE TO RELATED APPLICATIONS

This application claims the benefit of U.S. Provisional Application No. 60/550,884, filed Mar. 5, 2004.

STATEMENT REGARDING FEDERALLY SPONSORED RESEARCH OR DEVELOPMENT

Not Applicable

BACKGROUND OF THE INVENTION

1. Field of the Invention

The present invention is directed to surface cleaning equipment, and more particularly to a low profile side squeegee assembly for surface cleaning equipment.

2. Background

Surface maintenance vehicles and cleaning devices have a long history subject to gradual innovation and improvement toward improved and oftentimes automated performance in removing debris and contamination from floors. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ a combination of squeegee assemblies for wiping dry a floor which has been cleaned by application of a cleaning solution of water and a detergent in conjunction with scrubbing action of one or more moving brushes. The squeegee assemblies are generally placed in various locations on the vehicle, including the rear and the sides.

The vertical profile of the side squeegee assembly generally limits how close the vehicle can get to walls and other objects. Particularly troublesome are so-called "toe kicks", which are typically present in where cabinetry or the like does not touch the floor, but has a recessed area to partially accommodate a persons foot (allowing one to stand close to the cabinet). They are also found in supermarkets to prevent damage from shopping carts to displays and freezer doors. A toe kick may have a vertical clearance beneath it of perhaps 100 mm, and the recess may extend from the wall by perhaps 100 mm. Generally, a surface maintenance vehicle is unable to clean under the toe kicks, requiring that floor underneath the toe kicks be swept and mopped manually by hand. In a large grocery store or warehouse, the additional cleaning step required by the toe kicks can be inconvenient, time-consuming and expensive.

The difficulty in accommodating toe kicks stems in part from the manner in which the side squeegee assembly is supported. Generally, the side squeegees are held in place by a four-bar suspension, which is usually mounted directly above the center of the squeegee blade. The suspension is typically spring-loaded using tension springs, and ensures that the squeegee blade maintains proper contact with the floor as the vehicle travels over any irregularities in the floor. In addition, the squeegee suspension ensures that the squeegee blade is also maintained in the proper angular orientation with respect to the floor, in order to optimize the effectiveness of the squeegee. Further, the squeegee suspension should be self-adjusting, to accommodate pad and brush wear.

Although an obvious modification might be to move the four-bar suspension from directly above the center of the squeegee blade, away from the sides and toward the center of the vehicle, leaving the squeegee blade protruding out the sides of the vehicle, it turns out to be ineffective, and a modified four-bar suspension performs poorly.

Accordingly, there exists a need for a side squeegee suspension with a limited height total, with a low profile extending out to a minimum distance, which conforms to different brush heights and pad thicknesses, which self-adjusts to accommodate pad and brush wear, which is protected from obstacles, which has a minimum gap between the squeegee blade assembly and the pad or brush, and which contains substantially all the cleaning solution within the range of straight forward travel to a 90-degree turn.

BRIEF SUMMARY OF THE INVENTION

The present embodiment is a device for maintaining a ground surface, comprising: a housing with a peripheral edge; a squeegee assembly; a plurality of torsion elements connected between said peripheral edge and said assembly, and configured to apply a downward biased force to maintain the squeegee assembly in contact with the ground.

A further embodiment is a device for maintaining a ground surface, comprising: a housing having a front, rear and side peripheral edges; at least one squeegee assembly having first and second longitudinal ends; and a plurality of connecting elements connecting said first and second ends to said housing, said connecting elements providing a bias force between said housing and said assembly to urge said assembly into contact with said surface.

A further embodiment is a device for maintaining a ground surface, comprising: a housing; and a squeegee assembly having a blade with an attachment edge and a ground contact edge, said ground contact edge being inclined inwardly toward said housing by virtue of either of bolts 48 being inclined relative to their mount, though the inclination is not visible in FIG 4.

There are other features of the invention defined by the claims. This summary is for convenience of the reader in becoming familiar with the subject matter.

DETAILED DESCRIPTION OF THE INVENTION

Figure 1:
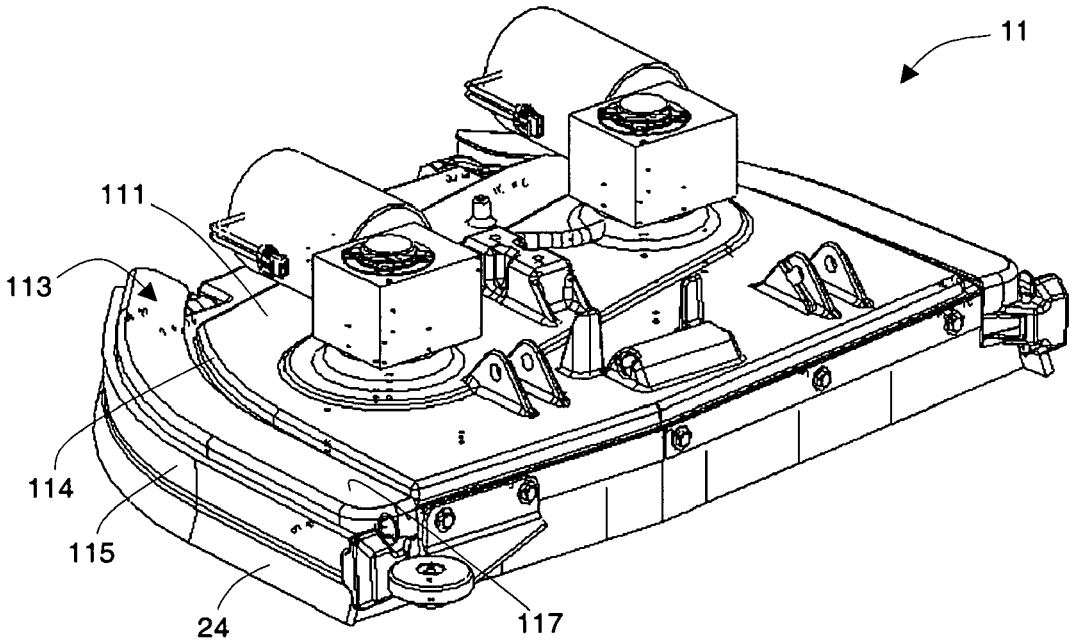
FIG. 1 is a perspective drawing of a nozzle housing of a surface maintenance vehicle, upon which two side squeegee assemblies are mounted.

FIG. 1 shows an exemplary nozzle housing 11 for a surface maintenance vehicle, equipped with an embodiment of a low profile side squeegee assembly. As drawn in FIG. 1, the front of the vehicle would be in the bottom right corner of the drawing, and the vehicle would travel from top-left to bottom-right. The floor is at the bottom of the page. The nozzle housing is generally pivotally attached to the frame of the vehicle, and is usually capable of being raised off the ground by an actuator, so that the squeegee blades do not damage the floor surface when the vehicle moves during a non-cleaning period.

In effect this embodiment show how the housing may be configured as two housings, an upper 111, and lower 113. The upper housing being joined at edge 114 to the lower and the lower having a peripheral edge 115 where the squeegee 24 is typically attached, thereby defining a space partially enclosed by the squeegee.

In order to clean under the toe kick of a cabinet, or the like, the lower housing must be able to clear the limited space defined between the ground the and the occluding object/cabinet. This is possible if the lower housing has an upper surface 117 whose distance from the ground is less than that of the defined space. Prior art devices could not accomplish this and, at the same time, provide a bias force of the squeegee on the ground because the mechanism for applying the bias force could not fit in the defined space within the lower housing, or in some other way it would create interference with that housing being able to clear the toe kick space and clean thereunder.

Figure 2:
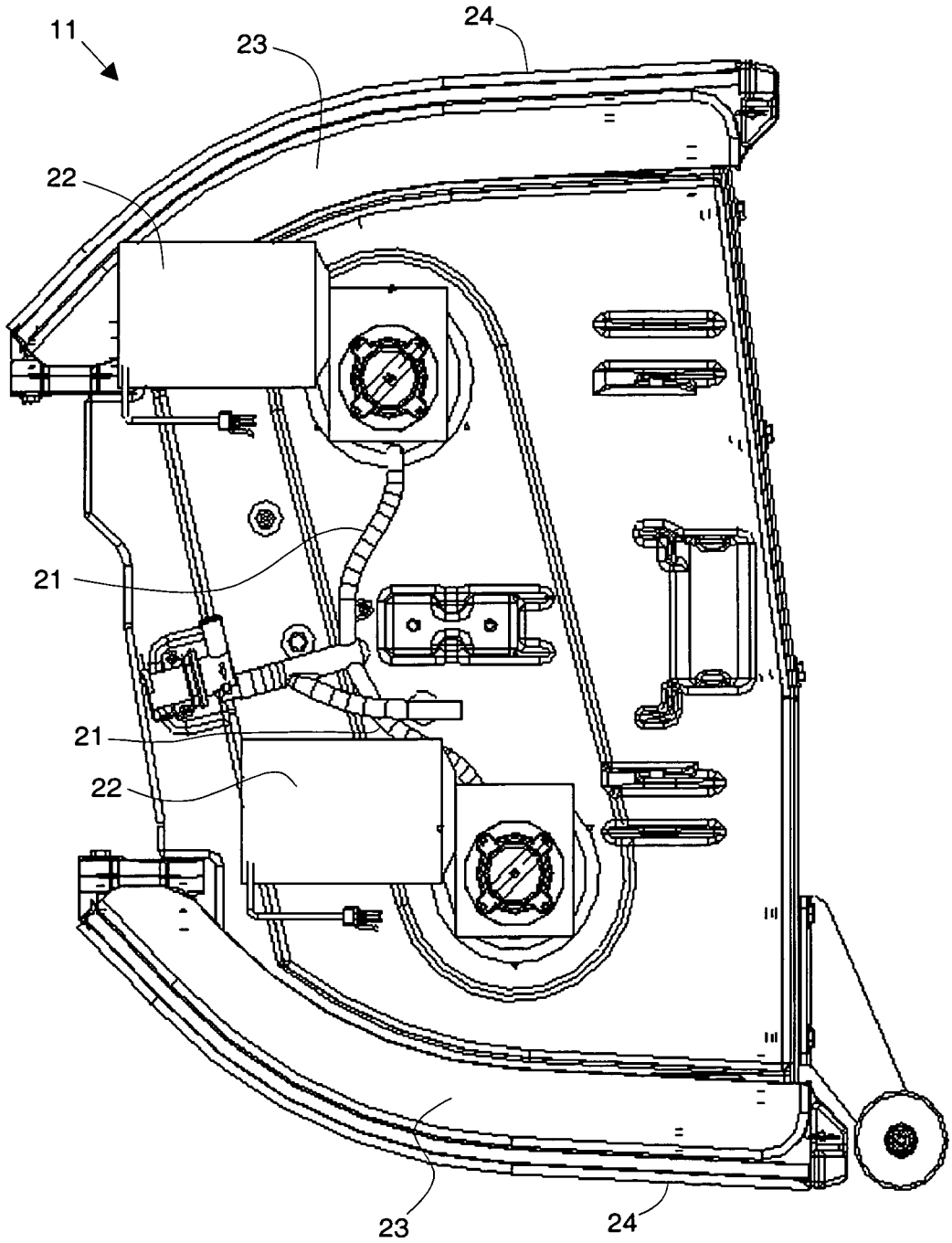
FIG. 2 is a top view drawing of the nozzle housing of FIG. 1

FIG. 2 shows the nozzle housing 11 in a top view, where the vehicle travels from left to right. A cleaning solution is delivered by tubing 21 to a pair of nozzles or brushes, which are driven by a pair of electric motors 22 but are not seen in FIG. 2 because they lie directly beneath the nozzle housing 11. The nozzles or brushes may be asymmetrically offset from each other, in order to optimize cleaning performance along the centerline of the vehicle. Optionally, more or fewer than two nozzles or brushes may be used. At the sides of the nozzle housing 11 are a pair of generally rigid squeegee holders 23, each of which supports a generally flexible squeegee blade 24.

Figure 3:
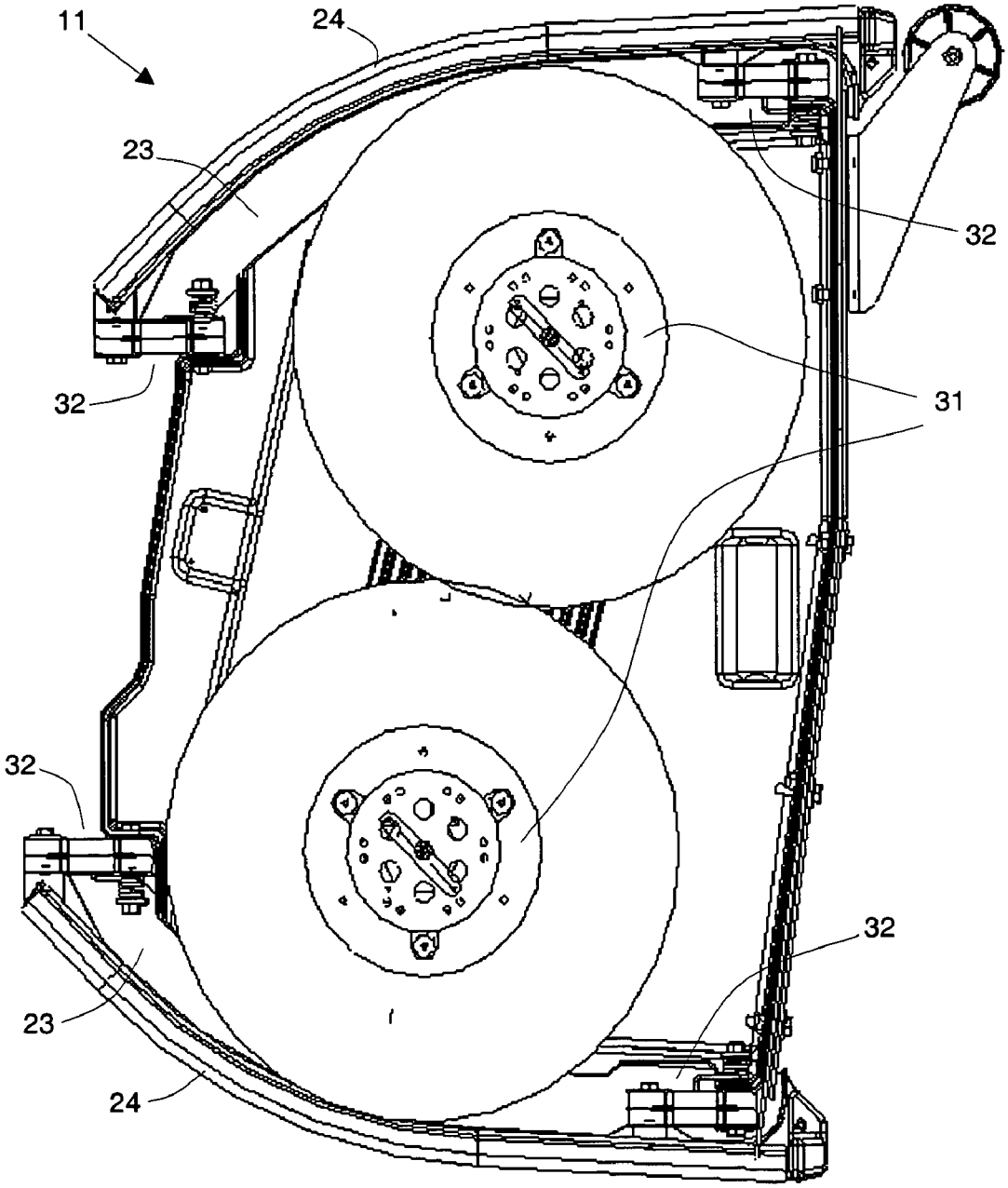
FIG. 3 is a bottom view drawing of the nozzle housing of FIGS. 1 and 2.

FIG. 3 shows the nozzle housing 11 in a bottom view, where the vehicle travels from left to right. The nozzles or brushes 31 are clearly seen in this view. Each squeegee holder 23 and squeegee blade 24 is attached to the nozzle housing 11 by a pair of torsion spring assemblies 32, preferably located at the front and rear edges of the squeegee holders 23.

Note that the exemplary torsion spring assemblies 32 can be substituted with any other variants to provide a low-profile and downward force from the nozzle housing 11 to the squeegee holders 23. For instance, a torsion bar can be biased to provide the biasing downward force For instance, a torsion bar or element (resilient element attached at its ends) can be substituted for the assembly 32 though it is not the preferred solution.

Figure 4:
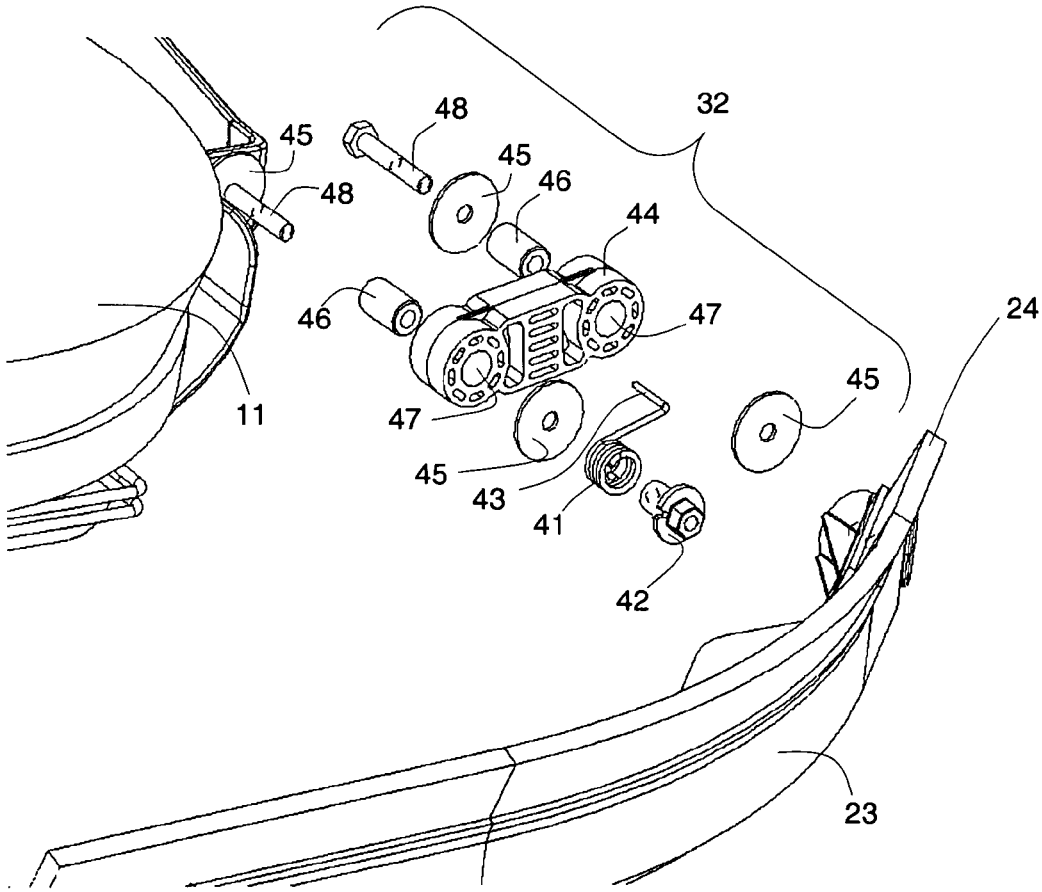
FIG. 4 is an exploded view drawing of a torsion spring assembly.

An exemplary torsion spring assembly 32 is shown in exploded view in FIG. 4. A torsion spring 41 surrounds and is anchored at one end by a notched mandrel 42, although any suitable support and anchor for the torsion spring 41 may be used in place of a notched mandrel 42, such as a spindle or supporting rod. The other end 43 of the torsion spring 41 is held in one of the slots in a slotted link 44. The slotted link 44 may be preferably molded from a durable plastic material, such as polycarbonate, although other materials may be used, including metals. In addition to providing an anchor for the torsion spring 41, the slots and other molded features shown in FIG. 4 may also assist in maintaining a near-uniform wall thickness throughout the part, which helps ensure that the part cools without deforming after molding. Alternatively, the slots may be shaped as a series of attachment points, rather than shaped as slots. Between the notched mandrel 42 and the slotted link 44 may be a spacer washer 45. A spacer tube 46 may be inserted into each hole 47 in the slotted link 44, in order to reduce wear on the slotted link 44, as well as relax the manufacturing tolerances of the slotted link 44. An additional spacer washer 45 may contact the slotted link 44 from the side opposite the torsion spring 41. A bolt 48 extends through the wall of the nozzle housing 11, through the spacer washer 45, through the spacer tube 46 located in a hole 47 in the slotted link 44, through another spacer washer 45, and screws into threads located inside the notched mandrel 42.

Analogous to parts described in the previous paragraph, a bolt 48 extends through a spacer washer 45, through a spacer tube 46 located in a hole 47 in the slotted link 44, through another spacer washer 45, and screws into threads located in the squeegee holder 23. In FIG. 4, the leftmost line of parts attaches the slotted link 44 to the nozzle housing 11, and the rightmost line of parts attaches the slotted link 44 to the squeegee holder 23.

Once the parts in FIG. 4 are assembled, the spring tension may be calibrated by adjusting the bolt 48 that attaches to the notched mandrel 42. Furthermore, an additional spring tension adjustment may be made by inserting the other end 43 of the torsion spring 41 into a different slot in the slotted link 44.

Figure 5:
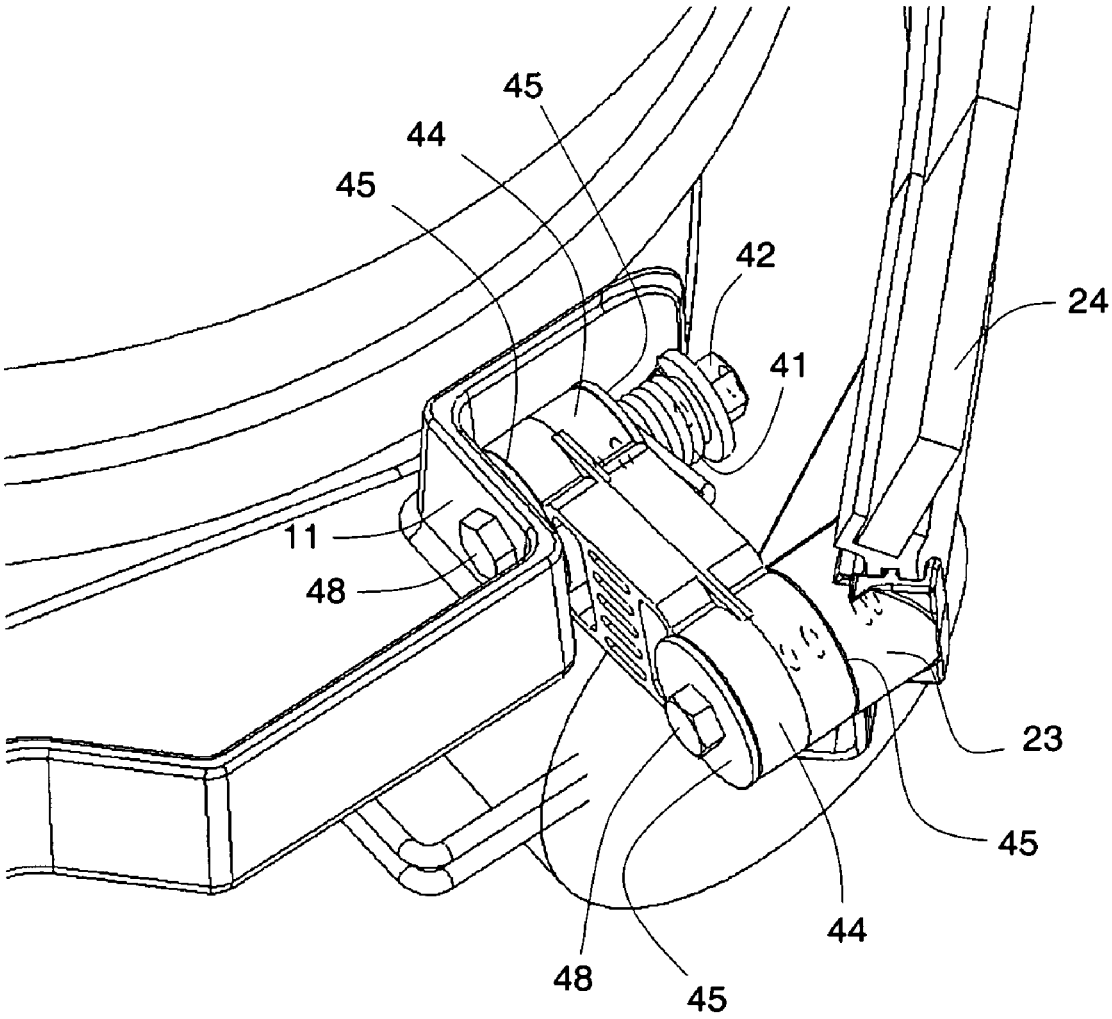
FIG. 5 is a perspective drawing of the torsion spring assembly of FIG. 4, assembled.

FIG. 5 shows an assembled torsion spring assembly, using the same part numbers as FIG. 4. It will be appreciated by one of ordinary skill in the art that the torsion spring assembly 32 shown in detail in FIGS. 4 and 5 is merely exemplary, and may be suitably reconfigured to have different combinations of washers, nuts, bolts and anchoring methods. For instance, the torsion spring 41 may just as easily be located in the other hole 47 in the slotted link 44, or on the opposite side of the slotted link 44.

It should be noted that the embodiment of the torsion spring 41 in FIGS. 4 and 5 generates a substantially tangential force with respect to its spiral core. It will be appreciated by one of ordinary skill in the art that various other embodiments of torsion springs may be used, each preferably with a low profile that allows the full spring assembly to be mounted near the periphery of the nozzle housing and relatively low to the ground. In addition, various other types of springs may be used, including extension, compression, and leaf springs.

In some known vehicles, the squeegee assembly is generally supported at the center, usually by a four-bar suspension. This center support distributes a downward force roughly uniformly over the squeegee blade, and as a result, the blade is well supported, and generally good performance is achieved. In order to provide a low-profile squeegee assembly that can fit under toe kicks, the linkages that provide a connection to the frame may be moved away from the center to the ends of the squeegee assembly. It is found that there potentially may be some undesirable twisting of the blade at the center, if it is supported only at the ends. It is also found that a slight inclination of the squeegee assemblies may counteract any potential twisting at the center, by changing the geometry at which the blade contacts the floor.

Figure 6:
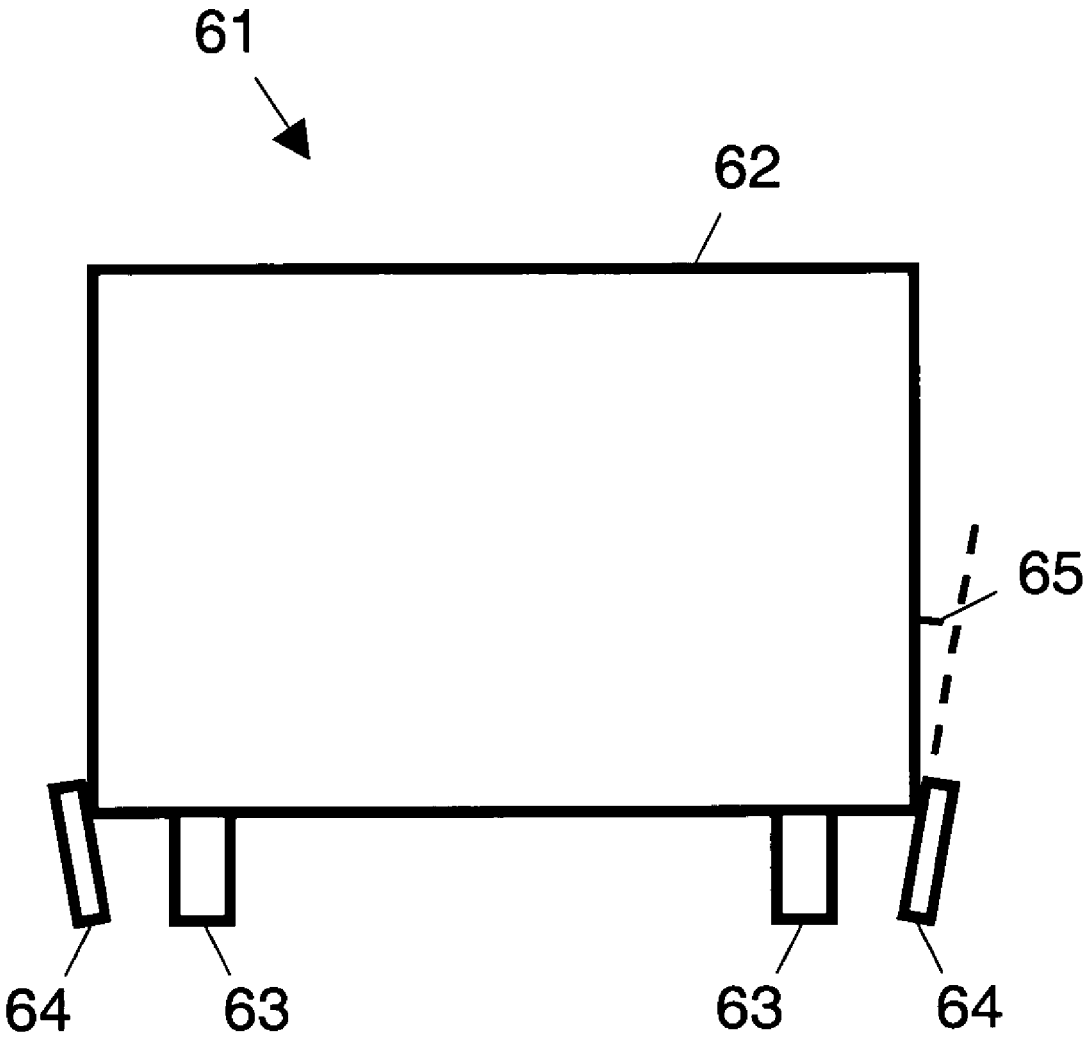
FIG. 6 is an end-on view drawing of a surface maintenance vehicle, showing the incline of the side squeegee assemblies.

This inclination is difficult to see in FIGS. 1-5, so it is redrawn and greatly exaggerated in FIG. 6. A surface maintenance vehicle 61 is shown in an end-on view, with a frame 62, wheels 63, and two side squeegee assemblies 64. The side squeegee assemblies 64 are mounted to the frame

62 at an angle, and are bent inward, as shown schematically in FIG. 6. In practice, the actual inclination 65 may be less than the +/−10 degrees drawn in the exaggerated FIG. 6. The inclination 65 may be built into the wall of the frame, the squeegee assembly, the slotted link that joins them, or any combination thereof. Although the inclination 65 is drawn in FIG. 6 as a rotation strictly about the longitudinal axis of the vehicle, there may be an additional rotational component about an axis transverse to the longitudinal axis of the vehicle.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A device for maintaining a ground surface, comprising:

a housing with a peripheral edge;

a squeegee assembly;

a plurality of torsion elements connected between said peripheral edge and said assembly, and configured to apply a downward biased force to maintain the squeegee assembly in contact with the ground and wherein each torsion element includes:

a link having first and second ends, one of said ends being attached to said housing and the other attached to said assembly; and a bias element at one of said ends connected to said link to provide said downward force and includes:

a torsion spring having ends;

a mandrel attachable to the housing or assembly, said mandrel securing one end of the torsion spring; and at least one attachment point in said link for securing the other end of the torsion spring and wherein the torsion spring includes a spiral core and wherein said mandrel passes through said spiral core; and wherein said mandrel includes a notch and wherein one end of said torsion spring is rotationally secured within said notch.

2. The device of claim 1, wherein the link includes:

first and second apertures; and first and second spacers sized to be received in said apertures and wherein said mandrel passes at least in part through one of said spacers.

3. A device for maintaining a ground surface, comprising:

a housing; and a squeegee assembly having a blade with an attachment edge and a ground contact edge, said ground contact edge being inclined inwardly toward said housing and further including a torsion element connecting said assembly to said housing and configured to incline said contact edge and wherein said housing includes an inclined attachment point and wherein said assembly is attached to said housing through said attachment point.

4. A device for maintaining a ground surface capable of accessing ground spaces substantially occluded by objects which are proximate the ground surface, comprising:

a first housing;

a second low profile housing being attached to said first housing and having an upper surface defining an at least partially enclosed space and a maximum upper clearance distance between the upper surface and ground surfaces, said upper clearance distance being less than the distance of said object to the ground, said second housing having a peripheral edge and a squeegee assembly at the peripheral edge thereof;

a plurality of torsion elements connected at one end to said second housing and said squeegee assembly, and located in said partially enclosed space, and configured to apply a downward biased force to maintain the squeegee assembly in contact with the ground.

5. The device of claim 4, wherein said torsion elements include:

a link having first and second ends, one of said ends being attached to said one of said housing ands the other attached to said assembly; and a bias element at one of said ends connected to said link to provide said downward force.

* * * * *